United States Patent [19]

Bucaille et al.

[11] Patent Number: 4,666,220

[45] Date of Patent: May 19, 1987

[54] STORAGE ELEMENT FOR LEISURE EQUIPMENT

[75] Inventors: Alain Bucaille, Quincampois; Gérard Robine, Franqueville, both of France

[73] Assignee: Alain Bucaille, Quincampoix, France

[21] Appl. No.: 750,835

[22] Filed: Jul. 1, 1985

[30] Foreign Application Priority Data

Jul. 2, 1984 [FR] France ..... 84 10451

[51] Int. Cl.[4] ..... A47B 81/00

[52] U.S. Cl. ..... 312/198; 40/611; 70/2; 211/70.5; 312/100

[58] Field of Search ..... 70/57, 58, 2; 40/611; 211/70.5; 312/100, 198

[56] References Cited

U.S. PATENT DOCUMENTS

| | | | |
|---|---|---|---|
| 3,008,785 | 11/1961 | Gehrs | 312/291 X |
| 3,047,349 | 7/1962 | Powell | 312/291 X |
| 3,797,284 | 3/1974 | Grossman | 70/58 |
| 4,001,987 | 1/1977 | Coulthard | 40/611 |
| 4,035,940 | 7/1977 | Mickey et al. | 40/611 X |
| 4,198,026 | 4/1980 | Capolupo | 70/58 X |
| 4,245,745 | 1/1981 | Verelle et al. | 211/70.5 X |
| 4,340,376 | 7/1982 | Williams | 70/58 X |
| 4,418,550 | 12/1983 | Hamilton | 70/2 X |
| 4,494,805 | 1/1985 | Washburn | 211/70.5 X |

FOREIGN PATENT DOCUMENTS

| | | | |
|---|---|---|---|
| 81417 | 6/1983 | European Pat. Off. | 312/100 |
| 2706330 | 8/1978 | Fed. Rep. of Germany | 211/70.5 |
| 1450736 | 8/1966 | France | 312/198 |
| 2414313 | 9/1979 | France | 211/70.5 |
| 464727 | 12/1968 | Switzerland | 70/58 |

*Primary Examiner*—Kenneth J. Dorner
*Assistant Examiner*—Thomas A. Rendos
*Attorney, Agent, or Firm*—Bachman & LaPointe

[57] ABSTRACT

The invention relates to the storage and sheltering of leisure equipment, such as equipment used in water sports and particularly windsurfing.

The invention provides a removable element comprising side walls standing on the ground, a back panel, a horizontal front cross-beam, partitions forming compartments which are narrower than the adult human body, lockable doors (P) for each compartment, flexible collars for gripping and securing a windsurf mast, a perforated arm for passing through the center plate well of a windsurf board so as to secure the board, and an anti-theft device for locking the wishbone to the arm, whereby to lock the board or the arm.

The element can be installed with other similar elements at the waterside to facilitate storage of the leisure equipment.

7 Claims, 5 Drawing Figures

STORAGE ELEMENT FOR LEISURE EQUIPMENT

BACKGROUND OF THE INVENTION

This invention relates to a modular element for storing and sheltering leisure equipment and particularly, but not exclusively, equipment and accessories for water sports such as windsurf boards, for example.

Certain water sports have achieved considerable development and growing success, both on sea-side beaches and on inland waterways. Among these water sports, sailing, water skiing, canoeing and, in recent years, windsurfing.

The equipments used for these sports are always big and cumbersome and the users do not always have the possibility to transport them with them each time they are used, nor store them in their homes, for example during holidays when the equipments are used daily; moreover, transporting the equipments is not only awkward but poses problems of size and road safety.

Windsurfers are particularly confronted by these problems and would like to leave on the spot their windsurf boards and accessories, including the mast, sail and wishbone.

Also, users arriving at the waterside wish to leave their personal belongings in security; however guarded premises are often insufficient in number for them to be able to leave their belongings in safety.

OBJECTS OF THE INVENTION

An object of the invention is to provide a modular structure which may be erected by private people or leisure organizations near the waterside so that users may leave their equipment and personal belongings in security.

BRIEF DESCRIPTION OF THE INVENTION

The present invention provides a modular structural element for storing windsurf equipment and other articles, comprising first and second side walls for standing on the ground to form uprights, a rear wall and a front cross-beam connecting said side walls, parallel partitions subdividing the space between said side walls into compartments an individual lockable door for each said compartment, each compartment being narrower than the width of an adult human body, first fixing means mounted on a first wall of each compartment for surrounding and securing a mast of a windsurf, and second fixing means mounted on a second wall opposite to said first wall, said second fixing means including a retention member for passing through a centre plate well of a windsurf board and locking means for attachment to said retention member so as to lock said board thereon.

Advantageously, it includes a floor member extending across the bottom of said compartments, said floor member comprising apertured material whereby water will drain from said compartments.

Preferably, said first fixing means comprises flexible belt means for surrounding said mast and fastening means for fastening said belt means.

DESCRIPTION OF THE DRAWINGS

Other features and advantages of the invention will appear from the following description of embodiments thereof given by way of example with reference to the accompanying drawings, in which.

DESCRIPTION OF THE PREFERRED EMBODIMENT

Figure 1:
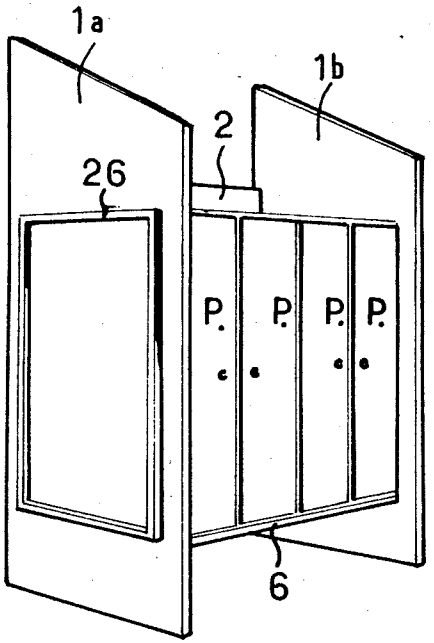
FIG. 1 is a general perspective view of a removable modular shelter and storage element in accordance with an embodiment of the invention.
Figure 3:
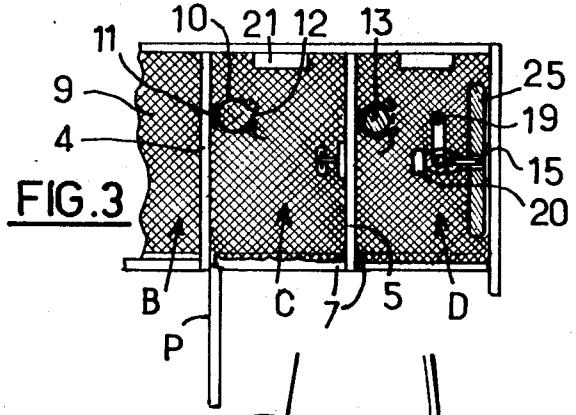
FIG. 3 is a partial plan view of the element of FIG. 1.
Figure 2:
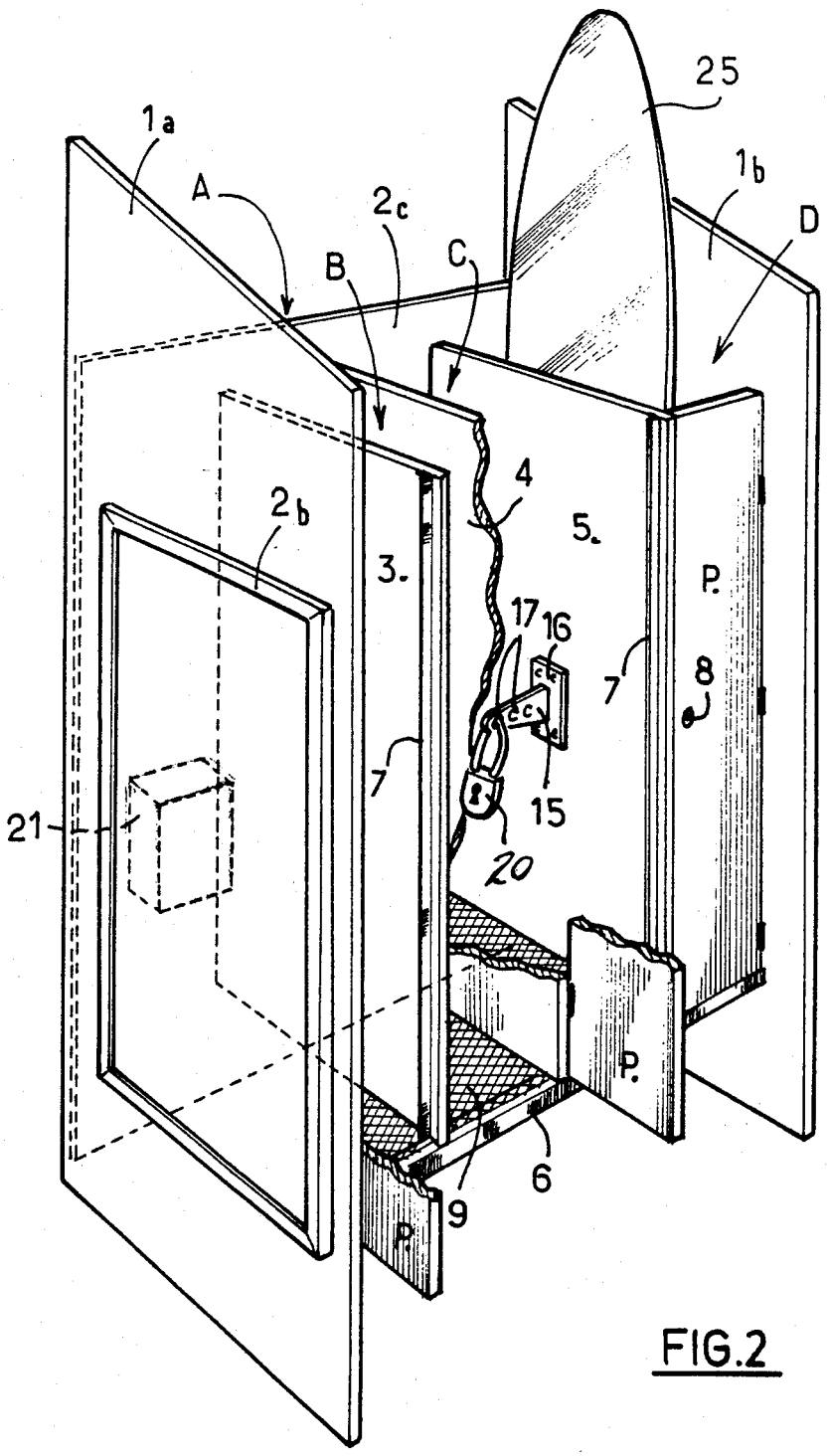
FIG. 2 is partly cut away perspective view, of the element of FIG. 1 to a larger scale.

The removable modular shelter and storage element shown in FIGS. 1 and 2 comprises two side walls 1*a*, 1*b* in the form of a trapezoid, the small edge of the trapezoid standing on the ground, the walls 1*a*, 1*b* being connected by a back panel 2 fixed along the back sides of the side walls.

On the back wall 2 are mounted orthogonally parallel partitions 3, 4, 5 whose front bottom corners are fixed on a horizontal cross-beam 6 connecting the side walls 1*a*, 1*b* together at a certain height above the ground.

The partitions 3, 4, 5 with the side walls 1*a* 1*b* define compartments A, B, C and D, and each compartment has a door P mounted on a hinge (not shown) in a suitable manner, the doors P being stopped by jambs 7 disposed so as to form fillisters behind which engages the bolt (not shown) of a respective lock 8 for each door P.

In accordance with this embodiment of the invention, the bottom of each compartment A, B, C, D is closed by a grill 9, for example, which is advantageously made of material which is insensitive to humidity, the grill comprising a net or trellis fixed on the front cross-beam 6, the rear panel 2, the side walls 1*a*, 1*b* and the bottom edges of each partition 3, 4 and 5.

Each compartment also comprises fixings for securing sports equipment or accessories, the fixings shown comprising at least one open collar 10 fixed by an intermediate portion thereof to a wall of the respective compartment as shown at 11, its free ends having suitable adjustable quick fit closure means 12.

The fixings may also comprise a belt or strap or other flexible link having suitable adjustable closure means, such as an overcenter locking device for example.

Figure 4:
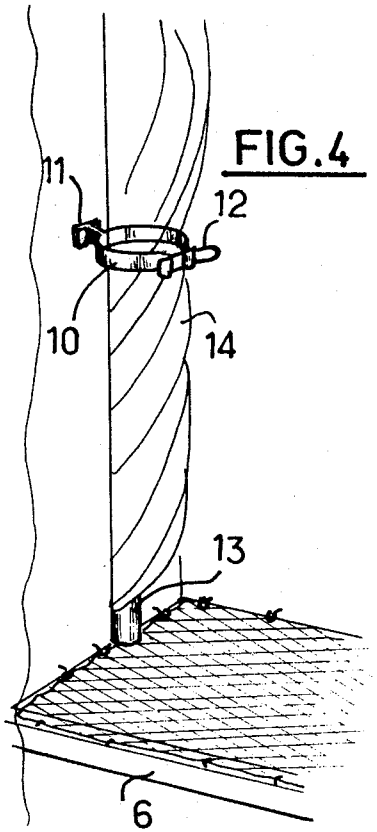
FIG. 4 is a partial perspective interior view of the bottom of a compartment in the element of FIG. 1, showing the rigging of a windsurf board and its fixing.

The fixings in the example illustrated are designed to fix the rigging of a windsurf board, comprising a mast 13 around which is rolled its sail 14. FIG. 4 shows in more detail one example of such a fixing system.

Each compartment also comprises further fixings for leisure equipment and accessories, including an arm 15 (FIG. 2) fixed securely on the wall of each compartment, for example by means of a flange 16 and comprising locking means which, in the example illustrated, comprise holes 17 through which passes the hook of a padlock 20.

Figure 5:
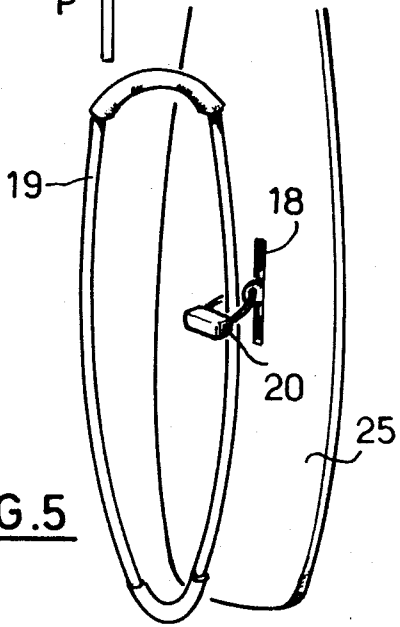
FIG. 5 is a side view of a windsurf board and its wishbone and their fixings.

This device may be used to secure a windsurf board inside the compartment, by passing the arm 15 through the center plate well 18 of the board as shown in FIG. 5. The wishbone 19 may also be secured by the padlock 20 being locked around one of the branches of the wishbone, the padlock hook passing through one of the holes 17 in the arm 15.

It will be understood that the arm 15 may be hinged on the wall of the compartment so as to be swing out of the way when the compartment is used to store articles other than a windsurf board.

Each compartment A, B, C, D also has a locker 21 which is fixed, for example, on the back panel at a height chosen for the locker to be too low to be accessible to a human hand from the top of the partition 2 or from the bottom cross-beam 6, the locker being closed by means of a door provided with a latch.

Although the drawings show the fixings for a windsurf board 25 and its rigging, including the mast 13, sail 14 and wishbone 19, it will be understood that other or further fixings may be provided in other forms suitable for securing in the compartment, for example water skis, air cylinders for skin diving, wet suits for diving, masks and other leisure equipment that the user may wish to leave on the spot at the end of each day.

It will be noted that the trapezoidal shape of the side walls 1*a*, 1*b* standing on their small edge enables an upper panel shown) to be fixed on the upper sloping edges of the side walls, if desired, to form a roof.

Each of the side walls 1*a*, 1*b* may be provided with a removable frame 26 in which may be positioned advertisements or other notices. Moreover, connecting means (not shown) may be provided in the form of coupling members such as hooks or the like so as to link several modular elements together to form a series.

The bottom of each compartment being closed by a meshed element, water dripping from the equipment, for example the sail 14, can flow freely down out of the element, and the circulation of air through the grill or net 9 and over the doors P which do not reach the tops of the side walls 1*a*, 1*b* dries humidity in the compartment.

The fixings 10, 15, and the locker 21 are fixed on the partitions or walls at a height chosen so that they are out of reach of a person trying to open them by reaching over the doors P. Even if the grill 9 is cut, the fixings and locker are still out of reach. It will be understood that this increases the security of articles stored in the compartments. The security is further improved, since the compartments are made very narrow (width less than the adult human body) so that potential pillagers cannot enter the compartments to gain access to the fixings nor the locker 21 with a view to cutting them or putting them out of action.

The invention is not limited to the constructional details shown: for example, other devices may be substituted for the arm 15, such as a chain or cable having rings for receiving an anti-theft lock, such as a padlock.

The modular element shown may be erected by private people or leisure organizations near the waterside, so that users may store their equipment and personal belongings. The elements are removable, so that during the off-season, they may be disassembled and removed.

We claim:

1. A modular structural element for storing windsurf equipment and other articles, comprising: windsurf equipment comprising a windsurf board having a center plate well, a wishbone member, a mast and a sail; first and second side walls for standing on the ground to form uprights; a rear wall and a front cross-beam connecting said side walls; parallel partitions subdividing the space between said side walls into compartments, said partitions extending from said rear wall to said front cross-beam parallel to said side walls, wherein said first and second side walls form compartment walls and said parallel partitions from compartment walls; an individual lockable door for each compartment engaging said parallel partitions; first fixing means mounted on a first compartment wall for surrounding and securing said mast and sail; and second fixing means mounted on a second compartment wall including a retention member for passing through said windsurf board center plate well and locking means for attachment to said retention member so as to lock said board thereon, wherein said retention member comprises an arm mounted on said second compartment wall, said arm presenting at least one hole, and said locking means comprising at least one padlock having a hook and a clasp, said padlock being dimensioned so that said hook may be passed through said hole and said clasp closed thereon around a branch of said wishbone member, whereby to lock said board and said wishbone member on said arm.

2. An element as claimed in claim 1 and including a floor member extending across the bottom of said compartments, said floor member comprising apertured material whereby water will drain from said compartments.

3. An element as claimed in claim 2 wherein said floor member comprises trellis work in a material which is insensitive to water.

4. An element as claimed in claim 1 and including locker means on walls of the respective compartments, at a height above the level of said front cross-beam.

5. An element as claimed in claim 1 wherein said first fixing means comprises flexible belt means for surrounding said mast and fastening means for fastening said belt means.

6. An element as claimed in claim 1 wherein each of said side walls presents a removable frame for receiving display means.

7. An element as claimed in claim 1 wherein said second fixing means is mounted on a second compartment wall opposed to said first compartment wall.

* * * * *